US005817428A

United States Patent [19]

Schlup et al.

[11] Patent Number: 5,817,428

[45] Date of Patent: Oct. 6, 1998

[54] PROCESS FOR FORMATION OF EPOXY RESIN/HIDE COMPOSITE MATERIALS AND MATERIALS OBTAINED

[75] Inventors: John R. Schlup; L. T. Fan, both of Manhattan, Kans.

[73] Assignee: Kansas State University Research Foundation, Manhattan, Kans.

[21] Appl. No.: 747,426

[22] Filed: Nov. 20, 1996

Related U.S. Application Data

[63] Continuation-in-part of Ser. No. 452,432, May 26, 1995, abandoned.

[51] Int. Cl.[6] ..... C14C 9/00

[52] U.S. Cl. ..... 428/540; 428/413; 428/473; 8/94.1 R; 8/94.19 C

[58] Field of Search ..... 428/413, 473, 428/540; 8/94.19 C

[56] References Cited

U.S. PATENT DOCUMENTS

| | | | |
|---|---|---|---|
| 3,066,997 | 12/1962 | Neher et al. . | |
| 3,103,447 | 9/1963 | Lowell et al. . | |
| 3,231,420 | 1/1966 | Lowell et al. . | |
| 3,441,365 | 4/1969 | Lowell et al. . | |
| 3,486,925 | 12/1969 | Hoffman | 525/523 |
| 3,795,533 | 3/1974 | Gauri | 428/540 |
| 5,183,845 | 2/1993 | Parkinson . | |

OTHER PUBLICATIONS

Friese, H.H. et al., "Waterproofing of Fashion Leathers", *Leder–Haeutemarkt* 38 (32), 5–6, 8–10 (1986).

Harris, E.H., "Graft Polymerization. III. Some Properties of teh Leather Obtained . . . Onto Chrome–Taned Nigerian Hairsheep", *J. Am. Leather Chem. Assoc.,* 69, 182 (1974).

Jordan, E.F. et al., "Polymer–Leather Composites. I. Process and Location Study . . . by Polymerization into Chrome–T-anned Cattlehide", *J. Appl. Polym. Sci.* 25, 2621–2647 (1980).

Jordan, E.F., Jr. et al., "Polymer–Leather Composites. II. Kinetics of the Deposition . . . into Chrome–Tanned Cattle-hide", *J. Appl. Polym. Sci.* 25, 2775–2776 (1980).

Jordan, E.F., Jr. et al., "Polymer–Leather Composites v. Preparative Methods . . . Polymer–Leather Composite Materials", *Polymer Applications of Renewable–Resource Materials* (Polymer Science and Technology, vol. 17) (C.E. Carraher, Jr. and L.H. Sperling, Eds.) (Plenum Press, New York, 1983) pp. 407–452.

Korn, A.H. et al., "Graft Polymerization. I. Preliminary Results with Acrylate Esters", *J. Am. Leather Chem. Assoc.* 67, 111 (1974).

Kronick, P.L. et al., "Viscoelasticity of Calf Hide Impregnated with Radiation–Polymerized Polyhydroyethyl Methacrylate", *Renewable Resource Materials* (C.E. Carraher, Jr. and L.H. Sperling, Eds.) (Plenum Press, New York, 1986) pp. 235–250.

Kronick, P.L. et al., "Dynamic Mechanical Properties of Polymer–Leather Composites", *J. Appl. Phys.* 30, 3095–3106 (1985).

Rao, K.P. et al., "Characterization of the Collagen–Vinyl . . . II. Infrared Spectra and electron Microscopy", *J. Appl. Polymer Sci.,* 16, 975–0986 (1972).

Rao, K.P. et al., "Characterization of the Collagen–Vinyl . . . I. Solution Properties", *J. Appl. Polymer Sci.,* a–1, 9, 3199–3212 (1971).

*Primary Examiner*—Donald R. Wilson

*Attorney, Agent, or Firm*—Hovey, Williams, Timmons & Collins

[57] ABSTRACT

A process for the formation of epoxy resin/hide composite materials is provided in which the components of epoxy resin systems (epoxy resin and hardener) are mixed at a temperature lower than that at which significant reaction between these reagents occurs. The epoxy resin system components are mixed into solution in an aprotic solvent, which prepares the epoxy resin system for impregnation into the hide. The hide, presoaked in an aprotic solvent for a period of time, is next placed in the epoxy resin system/aprotic solvent solution for a period of time, during which the hide is impregnated with the epoxy resin reactants. Once impregnated, the hide is removed from the solution, and the excess epoxy resin material is removed from the hide surface. Thereafter, the solvent may be evaporated from the system, although this step is optional. The impregnated hide is further processed at an elevated temperature (but at a temperature lower than that at which hide decomposes significantly—105°–160° C.) and at an elevated pressure, by such means as a hot press or autoclave, to ensure complete impregnation of the hide and to effect an in situ reaction or cure of the epoxy resin impregnated in the hide. Resultant resin/hide products are tough, impact-resistant and have very low moisture vapor transmission properties.

6 Claims, 2 Drawing Sheets

PROCESS FOR FORMATION OF EPOXY RESIN/HIDE COMPOSITE MATERIALS AND MATERIALS OBTAINED

RELATED APPLICATION

This is a continuation-in-part of application Ser. No. 08/452,432, filed May 26, 1995 now abandoned.

BACKGROUND OF THE INVENTION

1. Field of the Invention

The present invention is broadly concerned with improved, epoxy resin impregnated hide composite materials and a process for the formation of such composite materials involving the impregnation of hide with epoxy resin materials for the purpose of improving the notch toughness, impact resistance, machinability, and vibration dampening qualities of the composite materials.

2. Background

Individually, hide (and leather) and epoxy resin materials have been used for decades in a wide variety of applications. Hide and leather materials, although relatively tough, scuff resistant and inexpensive, lack in relative tensile strength and modulus qualities. Epoxy resin materials, on the other hand, tend to have physical properties with relatively high tensile strength and modulus values, but are typically brittle at ambient temperatures, and thus lack toughness and scuff resistant qualities. In addition, epoxy resins tend to be rather expensive as a material of construction.

Further, various processes are known to increase the toughness and scuff resistant properties of leather materials. For instance, it is already known that leather can be impregnated with organic solvent solutions of certain polymeric substances, with and without plasticizers (U.S. Pat. No. 3,231,420). It is also already known that: (i) leather can be coated with various materials such as ammonium salts of acidic copolymers (U.S. Pat. No. 3,103,447); (ii) leather can be impregnated with certain polymeric materials in an aqueous solution in such a manner that the entire corium minor is penetrated where a substantial amount of copolymer is deposited within the corium minor and at the junction of the corium minor and the corium major (U.S. Pat. No. 3,103,447); and (iii) leather can be impregnated with a composition comprising an organic solvent solution containing polyisocyanate with a polymeric compound, where the composition penetrates into the corium minor, but up to approximately one-third of the total leather thickness (U.S. Pat. No. 3,441,365). In the U.S. patents identified above (the teachings of which are incorporated herein by reference), leather materials are treated to improve their break characteristics, as well as to improve resistance to scuffing and abrasion. In each of the patents, complete impregnation of the leather is not achieved, which operates to limit the extent to which the toughness, strength, and modulus of the material may be improved.

U.S. Pat. No. 3,486,925 described flexible, fibrous, porous sheets having significant moisture vapor transmission properties prepared by treating leather with a finish or coating of an epoxy resin together with a polyether polyamine hardener having a molecular weight in excess of 1,000, with a maximum polymer loading of up to 10 g total resin per square foot of leather. The treated leather products are designed for good durability under prolonged repeated flexure, i.e., the products exhibit good flex fatigue (Bally flexure of either no failure or of slight cracking over 114,000–191,000 cycles, and Newark flex testing demonstrated finish unaffected through 400,000 cycles). The '925 patent further discloses that the moisture vapor transmission of the products range from 4.2 to 32.4 g/m$^2$/hr with an ultimate elongation exceeding 50% and ultimate tensile strength of around 200 psi and above. Thus, products made in accordance with this patent are not designed to maximize rigidity, impact strength and moisture impermeability.

Accordingly, there is a need for a composite material which enjoys good strength and modulus properties, while also being tough and impact resistant. Further, inasmuch as the mechanical properties of hide can vary widely, there is a need for a hide composite possessing relatively uniform mechanical properties.

Such improved composite materials are needed in the leather industry, gasket and packing industries, and in industries requiring vibration dampening materials (as part of laminated structures), impact resistant composite materials, and structural composite materials.

SUMMARY OF THE INVENTION

The present invention overcomes the problems outlined above and provides improved epoxy resin/hide composite materials having improved toughness and impact resistant qualities, while retaining many of the desirable physical properties associated with epoxy resin materials (tensile strength and modulus). The invention is predicated upon the discovery that the impregnation of hide with epoxy-based polymers using aprotic solvents, such as dimethyl formamide (DMF), results in substantially complete impregnation of the epoxy resin within the hide, which forms a composite with an unexpectedly high degree of toughness.

As used herein, the term "epoxy resin" means a thermoset resin based upon the reactivity of an epoxide functional group. One type of epoxy resin, for example, is composed of (or produced from) epichlorohydrin and bisphenol A. Aliphatic polyols such as glycerol may be used instead of the aromatic bisphenol A. Another type is made from polyolefins oxydized with peracetic acid. Many modifications of the various types of epoxy resins are produced commercially. The reactive epoxys form a tight cross-linked polymer network and are characterized by effective adhesion, strong corrosion and chemical resistance, and good dielectric properties. Most epoxy resins are of the two-part type, which harden when blended.

As used herein, the term "aprotic solvents" means those solvents identified as aprotic solvents in Reichardt, *Solvents and Solvent Effects in Organic Chemistry* (VCH Verlagsgesell-schaft mbH, Weinheim, Germany, 1990).

In accordance with the present invention, the components of epoxy resin systems (epoxy resin and hardener) are mixed at a temperature lower than that at which significant reaction between these reagents occurs.

Further, the epoxy resin system components are mixed into a dispersion or solution in an aprotic solvent, which prepares the epoxy resin system for impregnation into the hide. The hide is preferably chrome tanned hide produced by the well known process of chrome tannage. A chrome tannage process involves the tannage of leather with chromium compounds, and chrome tanned hide is distinguished from other kinds of tanned hide by its bluish or greenish color, particularly of a cut edge. Chrome tanned hides are further understood to be hides which have not yet been dyed or fat liquored (see *Practical Leather Technology,* Kreiger Publishing Co., 1985, pp. 317 and 395, incorporated by reference herein). In any case, the hide presoaked in an aprotic solvent for a period of time, is next placed in the epoxy resin system/aprotic solvent solution for a period of time, during which the hide is impregnated with the epoxy resin reactants. Once impregnated, the hide is removed from the solution, and the excess epoxy resin material is removed from the hide surface. Thereafter, the solvent may be evaporated from the system, although this step is optional. The impregnated hide is further processed at an elevated temperature (but at a temperature lower than that at which hide decomposes significantly—105°–160° C.) and at an elevated pressure, by such means as a hot press or autoclave, to ensure complete impregnation of the hide and to effect an in situ reaction or cure of the epoxy resin impregnated in the hide.

The preferred epoxy resin system in the impregnation of hide is diglycidyl ether of bisphenol A (DGEBA) with the curing agent, 1,3-phenylenediamine (MPDA). Two or more epoxy resin monomers may be used in the practice of the instant invention provided that the viscosity of the monomers in a solution with solvent is sufficiently low to permit full hide impregnation. The preferred aprotic solvent is DMF.

In order to achieve the desirable degree of toughness, impact resistance and moisture impermeability, the epoxy resin systems of the invention should be used at loading levels of at least about 15 g/ft$^2$ (i.e., 15 grams of epoxy resin system per square foot of composite material), and more preferably at a loading level of at least about 50 g/ft$^2$, and most preferably from about 50–500 g/ft$^2$. The finished composites should have from about 10–50% by weight cured epoxy resin system therein, and more preferably from about 20–45% by weight.

It is theorized that the resulting hide composite consists of an interpenetrating polymer network. When hide is tanned, collagen fiber is cross-linked in the hide. The epoxy-resin-system monomers penetrate the collagen network which had been swelled by exposure to the solvent. When the hide impregnated with the epoxy system is exposed to a hot press, the epoxy resin cures within the collagen network.

Aprotic solvents are well adapted for practicing the instant invention because they are well suited as a swelling media for the hide and as diluents to reduce the viscosity of the solution of epoxy resin reactants to assist with impregnation of the hide. The solvent possessing active hydrogens on the molecules would tend to react with the reagents of the epoxy resin.

By definition, a protic solvent has a hydrogen atom attached to an oxygen or nitrogen atom and, therefore, shows appreciable acidity. An aprotic solvent, conversely, undergoes only limited self-ionization; it has no acidic hydrogen atom as part of the molecule. Thus, it is believed that aprotic solvents are particularly well adapted because they act as swelling media, and at the same time do not appreciably interact with the epoxy resin reagents because they lack the acidic hydrogen atom as part of the solvent molecule. These factors, together with other factors, therefore, are theorized to play a role in a solvent's ability to improve the accessibility of the epoxy resin reagents to the collagen fiber network of the hide, and include:

(a) relative volatilities of the solvent;

(b) solvent effects during polymerization;

(c) acid-base properties of the solvent;

(d) the aprotic nature of the solvent; and (e) the dipole moments of the solvent.

In the last respect, it is likely that the dipole moments of the solvent molecules influence the way in which the molecules interact with the functional groups involved in the polymerization reactions.

The preferred solvents for use in the practice of the instant invention are represented by any of the following general formulas:

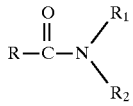

where R is a hydrogen atom or a $C_1$–$C_4$ alkyl group and $R_1$ and $R_2$ are independently selected from the group consisting of $C_1$–$C_4$ alkyl groups;

or

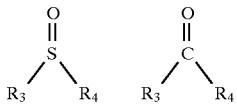

where $R_3$ and $R_4$ are independently selected from the group consisting of $C_1$–$C_4$ alkyl groups.

A wide variety of curing agents or hardeners can be used in carrying out the invention. For example, various amines, acid anhydrides, carboxylic acids, Lewis acids, imidazoles and dicyandiamide can be used. Generally, low molecular weight curing agents are preferred, and especially those having a molecular weight of less than 1,000 and more preferably less than about 700.

While the preferred embodiment incorporates a process involving a hot press to ensure substantially complete hide impregnation, full impregnation can be accomplished without the aid of a hot press. The depth of penetration, as taught by U.S. Pat. No. 3,441,365, can be controlled without the aid of a hot press, by the amount of solution applied, once the penetrability of the solution has been regulated (i.e., proper selection of viscosity and surface tension of the ingredients and their proportions) so as to allow complete penetration of the solution in the first place. For example, a hide's upper level will absorb roughly its own weight in liquid. Thus, for full penetration, the hide should be allowed to absorb an amount of solution equalling roughly its own weight.

Final impregnated products in accordance with the invention have very low moisture vapor transmission properties, generally below about 7.5 g/m$^2$/hr, and more preferably less than 3 g/m$^2$/hr. Moisture vapor transmission properties are measured in accordance with ASTM Standard Test Procedure D5052-90 incorporated by reference herein, with the following alteration: In order to measure true moisture vapor transmission rates, the sample(s) are equilibrated at the test conditions prior to beginning the permeability test, so that changes in mass reflect only increases in mass due to moisture gain by the desiccant.

The products of the invention also have sufficient rigidity so that flexural fatigue cannot be measured by standard methods such as the Bally flex test or Newark flex test. The elastic moduli of the products hereof is in excess of 500 MPa, and more preferably above 1000 MPa, whereas the flexural moduli is in excess of 300 MPa, and more preferably above 1000 MPA. The ultimate elongations of the products of the invention are typically less than about 30%, and more preferably less than about 25%. Ultimate tensile strengths of the products hereof are very high, usually about 15 MPa or above, and more preferably at least about 30 MPa. The toughness (ASTM D-638-90, Type I specimen, incorporated by reference herein) is at least about 0.25 MPa and more preferably at least about 2.5 MPa. The Izod impact strength (ASTM D-638-90b, incorporated by reference herein) is at least about 0.5 ft.lb/in., and more preferably at least about 1.5 ft.lb/in.

DETAILED DESCRIPTION OF THE PREFERRED EMBODIMENTS

Figure 1:
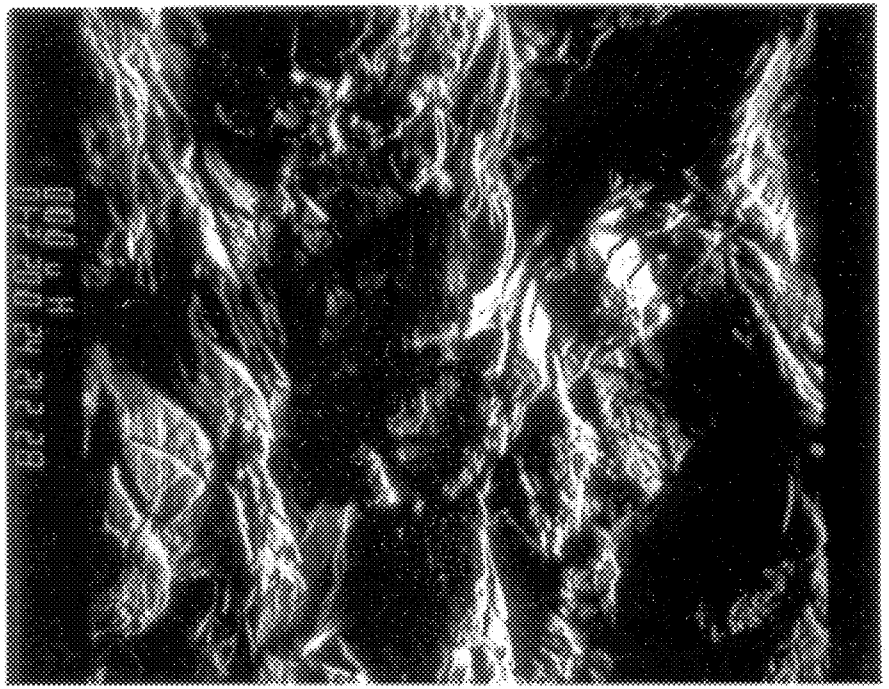
FIG. 1 is a scanning electron micrograph showing an unpolished cross-section hide alone.

The following examples set forth preferred embodiments and techniques for the formation of epoxy resin/hide composite materials, as well as test results demonstrating various desirable properties of the composite materials. It is to be understood, however, that these examples are presented by way of illustration only and nothing therein should be taken as a limitation upon the overall scope of the invention.

EXAMPLE 1

Fabricating Epoxy/Hide Composite Materials with DMF as a Solvent

The hide samples of this example were chrome-tanned cattle hide. The hide samples were cut from consecutive locations on the full hide, with the long dimension being perpendicular to the hide adjacent to the backbone. The hide was sliced (with the grain side retained) to make rectangular dynamic mechanical analysis (DMA) samples, each having dimensions of approximately 25×8.5×2.5 mm.

The epoxy resin chosen was diglycidyl ether of bisphenol A (DGEBA) [Epon(R) resin 825 (lot number 061HJ351)] obtained from Shell Chemical Company, having an epoxide equivalent weight of 175–180 and viscosity (50–65 poise at 25° C.), as disclosed in Shell Technical Bulletin SC:235-88.825 (incorporated herein by reference). 1,3-phenylenediamine (MPDA) was the hardener or curing agent, the technical data for which are disclosed in Aldrich Chemical Company Material Safety Data Sheet for Product No. P2395-4 (incorporated herein by reference), and dimethyl formamide (DMF) (30 wt %) was the solvent. All components were used as received.

The chrome-cured hide samples were presoaked in DMF for 8 hours to attain complete impregnation of the hide by the solvent. DGEBA and MPDA were mixed to provide equal numbers of active amine hydrogens (in the MPDA) and epoxide functional groups (in the DGEBA) (i.e., a stoichiometric ratio of 1:1), and the samples presoaked in DMF were placed in the DGEBA/MPDA solution for 12 hours. The samples were blotted dry upon removal from the solution.

The samples were cured in a MTF-8 Hot Press (Tetrahedron Associates, Inc.) The cure schedule was 80° F. for 1 hour, 175° F. for 1.5 hours, 200° F. for 1.5 hours, 225° for 8 hours, and 80° for 1 hour. The system pressure was 2 $lb_f$ (equivalent to 12.9 psi or 88.8 kPa).

The samples were washed in acetone to remove unreacted resin. The wash consisted of a first 5-hour soak in fresh acetone after which the samples were removed and placed in fresh acetone for an additional 5 hours. The samples were blotted dry between the two soak periods.

The samples were dried in a vacuum oven for 2 hours at room temperature at minimum vacuum (less than 28 in. Hg., an absolute pressure of less than 0.065 atm. or less than 50 torr) to remove the acetone from the samples.

Pressed hide samples and a cured epoxy resin sheet were prepared in the hot press with the same force and heat treatment schedule followed for cured epoxy impregnated hide. The cured epoxy resin sheet was obtained using an aluminum mold lined on both sides with release agents. Rectangular epoxy resin samples, each with dimensions of 25×8.5×1.6 mm were cut from the epoxy resin sheet. The release agent, with the trade name "Release-All 40", is manufactured by Air Tech International, Inc. Any conventional release agent for cure of an epoxy resin system would be satisfactory for the practice of the instant invention. The final epoxy resin content in the hide ranged from 10–39wt %.

Complete impregnation of resin to the hide centerline was confirmed by observing fractured cross-sections with a scanning electron microscope. The presence of epoxy resin at the centerline of the sample of the hide was confirmed by the observation of relatively clean fracture edges characteristic of epoxy resin fractures. Since it is relatively brittle at ambient temperatures, epoxy resin presents a more uniform surface when cut in cross-section, as opposed to the porous, fibrous surface characteristic of the cross-section of unmodified hide.

The summary of the mechanical property data from ASTM standard test procedures for epoxy resin/hide composites made according to the procedure of this example appears in Table 1.

EXAMPLE 2

Fabricating Epoxy/Hide Deposit Materials with MEK as a Solvent

The hide samples in this example were identical to those in Example 1.

The epoxy resin chosen was DGEBA [Epon(R) resin 825 (lot number 061HJ351)] obtained from Shell Chemical Company. MPDA was the curing agent. Methylethyl Ketone (MEK) was the solvent. All components were used as received.

The chrome-cured hide samples were presoaked in MEK for 2 hours. DGEBA and MPDA were mixed at a mass ratio of 7:1, and the mixture was dissolved in MEK at room temperature. The hide samples presoaked in MEK were placed in a DGEBA/MPDA solution for 2 hours. The samples were blotted dry upon removal from the solution.

The samples were cured in a MTP-8 Hot Press (Tetrahedron Associates, Inc.) The cure schedule was 4 hours at 27° C., 1.5 hours at 79.5° C., 1.5 hours at 93° C., and 1.5 hours at 107° C. The system pressure was 1.0 $lb_f$ (equivalent to 6.45 psi or 44.5 kPa).

Pressed hide samples and a cured epoxy resin sheet were prepared in the hot press with the same force and heat treatment schedule followed for cured epoxy impregnated hide. The cured epoxy resin sheet was obtained using an aluminum mold coated on both sides with release agents. Rectangular epoxy resin samples, each with dimensions of 25×8.5×1.6 mm, were cut from the epoxy resin sheet.

The average epoxy resin content of the hide was 23 wt %. The wt % of epoxy resin in the hide, as disclosed herein, is calculated as follows:

$$\text{wt } \% = \frac{[\text{final mass of sample}] - [\text{initial mass of hide}]}{[\text{final mass of sample}]} \times 100\%$$

The wt. % epoxy resin content can be converted to g/ft$^2$ by the following equation:

$$\text{mass of polymer in g/ft}^2 = 0.01\ (\text{wt. }\%)(\text{total mass in g/ft}^2)$$

The summary of the mechanical properties from ASTM standard test procedures for epoxy resin/hide composites made according to the procedure of this example appears in Table 1.

TABLE 1

Summary of Property Data for Epoxy Resin/Hide Composites

| Sample | Young's[1] Modulus (MPa) | Breaking[2] Strength (MPa) | % Strain at[3] Failure | Toughness[4] (MPa) | Izod Impact[5] Strength (ft · lb$_f$/in) |
|---|---|---|---|---|---|
| Impregnated Hide (DMF) | 1470 (92) | 45.4 (2.8) | 20.85 (1.9) | 6.975 (.52) | >14.3 |
| Impregnated Hide (MEK) | 3166 (317) | 35.6 (4.6) | 1.46 (.14) | 0.2859 (.07) | 1.77 |
| DGEBA/MPDA | 3003 (101) | 63.6 (6.2) | 3.31 (.7) | 1.339 (.464) | 0.21 |
| Hide | 80.3 (81.2) | 20.4 (7.4) | 64.7 (25.3) | 4.905 (1.235) | N/A |
| Pressed Hide | 80.8 (5.9) | 25.5 (3.5) | ~30 | 4.426 (.824) | N/A |

Data in parentheses are the standard deviation for the measurement reported.

[1]Young's modulus was calculated from the slope of the linear portion of the stress-strain curve obtained from a tensile test (following ASTM standard test procedure D 638-90, Type I specimen).

[2]Breaking strength was the stress observed at failure during a tensile test (following ASTM standard test procedure D 638-90, Type I specimen).

[3]The % strain at failure was obtained from tensile test data (following ASTM standard test procedure D 638-90, Type I specimen). The % strain at failure reported was calculated as engineering strain. No allowance was made for elastic retaxation subsequent to failure. The value reported was the % strain measured immediately prior to failure of the materia.

[4]Toughness was reported as the area under the stress-strain curve (following ASTM standard test procedure D 638-90, Type I specimen).

[5]The Izod impact strength was obtained by following ASTM standard test procedure D 638-90b.

As evident from the data present in Table 1, the epoxy resin/hide composite made according to the process of the instant invention possesses an Izod impact strength far greater than that of the epoxy resin alone. Young's modulus for the composite is equivalent to that of the epoxy polymer itself. Breaking strength, % strain at failure, and toughness are intermediate between the pure resin and the hide alone and can be tailored by choice of process conditions.

Composites made according to the instant invention also possess enhanced uniformity in mechanical properties even though such properties associated with hide alone can vary widely.

In the practice of the instant invention, the glass transition temperature ($T_g$) of the epoxy resin within the epoxy/hide composites may be increased by optimizing the cure schedule. The data developed as part of those reported in Table 1 indicated that the hide/epoxy resin samples had a $T_g$ of approximately 100° C. The glass transition temperature may be increased to 130° C. by the mere adoption of new cure schedules. Increasing the glass transition temperature increases the tensile strength and modulus of the composite (especially at temperatures in the range between 70°–130° C.).

Methodology for Verifying Impregnation of the Hide/Leather.

Figure 2:
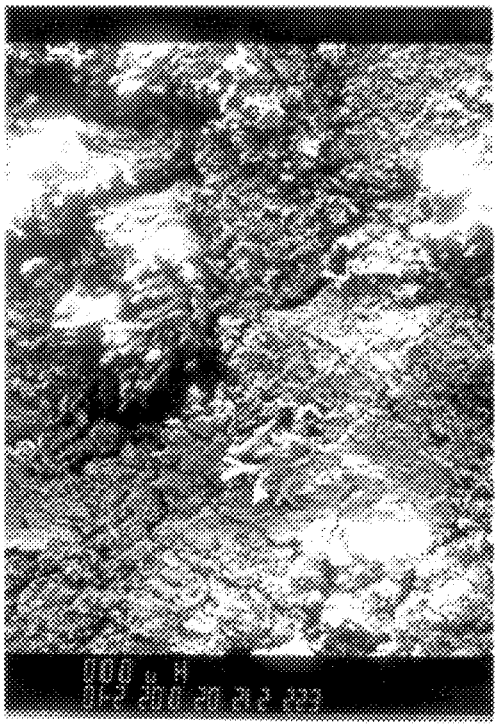
FIG. 2 is a scanning electron micrograph showing an upolished cross-section of an epoxy/hide sample.
Figure 3:
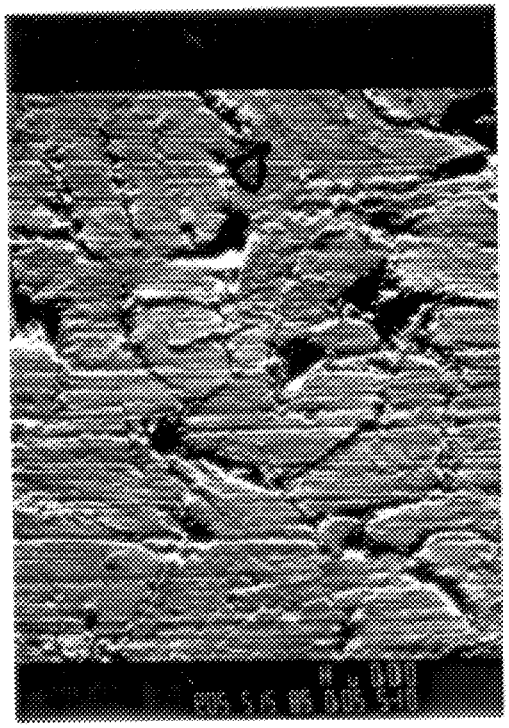
FIG. 3 is a scanning electron micrograph showing a polished cross-section of an epoxy/hide sample.

Impregnation of hide/leather, such as in the case of the examples disclosed herein, can be monitored by visual inspection according to the following method. Samples are cross-sectioned with a knife and the cross-section is observed under either an optical or a scanning electron microscope. Examples of scanning electron micrographs of hide and epoxy resin/hide samples are shown in FIGS. 1–3 (in each FIGS. 1–3, a distance of 10 micrometers is represented by the width of the "H" bar appearing at the bottom of the micrograph). FIG. 1 is a scanning electron micrograph showing an unpolished cross-section hide alone. FIG. 2 is a scanning electron micrograph showing an upolished cross-section of an epoxy/hide sample. FIG. 3 is a scanning electron micrograph showing a polished cross-section of an epoxy/hide sample.

As shown in FIG. 1, hide/leather itself has a texture that is obviously fibrous and exhibits significant porosity between the fibers. The texture of the cross-sectioned hide is sufficiently rough that it is difficult for optical microscopy to provide meaningful depth of view. One will have difficulty seeing both the fibers on the surface and the porous interior of the cross-section. Scanning electron microscopy provides a better depth of view and more complete observation of the fibrous texture and it is possible to view the porosity of the cross-section.

If the hide/leather material has been impregnated, polymer fills the voids between the collagen fibers of the hide/leather. While collagen fibers can be observed, the texture of the cross-section does not appear fibrous, as is shown in FIGS. 2 and 3. Porosity is not apparent since the polymer fills the voids. It is difficult to distinguish the collagen fibers embedded in the polymer with simple light-field microscopy. Polarizing light is helpful. Darkfield or phase contrast microscopy would be preferred if one wishes to discriminate polymer from individual collagen fibers.

The fibrous texture of unimpregnated regions of the samples makes it relatively easy to determine the extent of impregnation, as is apparent from a comparison of FIGS. 1 and 2. The presence of polymer in the voids of the hide results in a smooth, nonporous appearance in those regions of the cross-section, which experience extensive impregnation. The regions filled by the impregnating polymer can be distinguished more readily from unimpregnated hide/leather if darkfield, polarizing, or phase contrast optics is available for optical microscopy since differences between the optical properties of the polymers and the collagen are expected.

The theories expressed herein are for explanation only and are not intended to restrict the scope of the invention as disclosed and claimed herein.

We claim:

1. An epoxy resin/hide composite comprising an animal hide presenting a matrix of hide fibers, said fibers separated by void spaces, said hide having impregnated essentially throughout its entire thickness a quantity of an epoxy resin polymer system within said void spaces, said epoxy resin polymer system being present at a loading of at least 15 $g/ft^2$, and resulting from the reaction of an epoxy resin containing a multiplicity of epoxy groups with a hardener, and said composite having a cured epoxy resin system content of between about 10–50 wt. %.

2. The composite of claim 1, said loading being at least about 50 $g/ft^2$.

3. The composite of claim 1, said epoxy resin polymer system comprising an epoxy polymer and a low molecular weight hardener, said hardener having a molecular weight of less than 1,000.

4. The composite of claim 2, said molecular weight being less than about 700.

5. An epoxy resin/hide composite comprising an animal hide presenting a matrix of hide fibers, said fibers separated by void spaces, said hide having impregnated essentially throughout its entire thickness a quantity of an epoxy resin polymer system within said void spaces, said epoxy resin polymer system resulting from the reaction of an epoxy resin containing a multiplicity of epoxy groups with a hardener, said composite having a cured epoxy resin system content of between about 10–50 wt. %, and, said composite having a moisture vapor transmission of less than about 7.5 $g/m^2/hr$, said moisture vapor transmission being measured in accordance with ASTM D5052-90 with equilibration of said sample at test conditions prior to beginning the ASTM test.

6. The composite of claim 5, said moisture vapor transmission being less than about 3 $g/m^2/hr$.

* * * * *